US011067229B2

(12) United States Patent
Van Bommel et al.

(10) Patent No.: US 11,067,229 B2
(45) Date of Patent: Jul. 20, 2021

(54) LED STRIP FOR INDIRECT LIGHT EMISSION

(71) Applicant: SIGNIFY HOLDING B.V., Eindhoven (NL)

(72) Inventors: Ties Van Bommel, Horst (NL); Rifat Ata Mustafa Hikmet, Eindhoven (NL)

(73) Assignee: Signify Holding B.V., Eindhoven (NL)

( * ) Notice: Subject to any disclaimer, the term of this patent is extended or adjusted under 35 U.S.C. 154(b) by 0 days.

(21) Appl. No.: 16/640,190

(22) PCT Filed: Aug. 20, 2018

(86) PCT No.: PCT/EP2018/072414
§ 371 (c)(1),
(2) Date: Feb. 19, 2020

(87) PCT Pub. No.: WO2019/038222
PCT Pub. Date: Feb. 28, 2019

(65) Prior Publication Data

US 2020/0182416 A1 Jun. 11, 2020

(30) Foreign Application Priority Data

Aug. 25, 2017 (EP) ..... 17187969

(51) Int. Cl.
*F21S 4/22* (2016.01)
*F21V 7/00* (2006.01)
(Continued)

(52) U.S. Cl.
CPC ..... *F21S 4/22* (2016.01); *F21V 7/0008* (2013.01); *F21Y 2103/10* (2016.08); *F21Y 2107/10* (2016.08); *F21Y 2115/10* (2016.08)

(58) Field of Classification Search
CPC ..... F21S 4/22; F21V 7/0008; F21Y 2107/10; F21Y 2103/10; F21Y 2115/10; F21Y 2107/00; F21K 9/68
See application file for complete search history.

(56) References Cited

U.S. PATENT DOCUMENTS 5,693,381 A 12/1997 Cheng
8,926,130 B2 * 1/2015 Li ..... F21V 29/83 362/249.02
(Continued)

FOREIGN PATENT DOCUMENTS

CN 203880449 U 10/2014
CN 106499985 A * 3/2017
(Continued)

OTHER PUBLICATIONS

Abstract in English of LV11956B, Apr. 1998, LV, Natalija Provornaja (Year: 1998).*

*Primary Examiner* — Rajarshi Chakraborty
*Assistant Examiner* — Glenn D Zimmerman
(74) *Attorney, Agent, or Firm* — Daniel J. Piotrowski

(57) ABSTRACT

Disclosed is a LED strip for providing indirect light emission. The LED strip comprises a plurality of LEDs arranged on an upper surface, wherein the LED strip has an unfolded state and a folded state, the LED strip being substantially planar in the unfolded state. The LED strip comprises a first side and a second side opposite to the first side, the first and second side being parallel to a central longitudinal axis in the unfolded state. The LED strip in the folded state has a plurality of first loops comprising at least one opening and being provided with at least one of the plurality of LEDs, which is configured to emit light towards a reflective interior surface of the loop, whereby at least a portion of the light
(Continued)

reflected from the reflective interior surface may exit the at least one opening of each loop.

14 Claims, 9 Drawing Sheets

(51) Int. Cl.
*F21Y 107/10* (2016.01)
*F21Y 103/10* (2016.01)
*F21Y 115/10* (2016.01)

(56) References Cited

U.S. PATENT DOCUMENTS

| | | | | |
|---|---|---|---|---|
| 9,410,665 | B2 | 8/2016 | Lind et al. | |
| 9,696,019 | B2 * | 7/2017 | Palfreyman | G09F 13/22 |
| 2002/0136004 | A1 * | 9/2002 | Rudoy | A45C 11/16 362/154 |
| 2009/0226643 | A1 | 9/2009 | Shih | |
| 2011/0051416 | A1 | 3/2011 | Verbrugh et al. | |
| 2013/0070170 | A1 * | 3/2013 | Namekata | G02F 1/133603 348/836 |
| 2013/0077298 | A1 * | 3/2013 | Steele | F21K 9/235 362/230 |
| 2014/0029264 | A1 * | 1/2014 | Tai | F21S 10/00 362/297 |
| 2014/0191668 | A1 | 7/2014 | Engelen et al. | |
| 2014/0321126 | A1 * | 10/2014 | Narag | F21K 9/00 362/306 |
| 2014/0369038 | A1 | 12/2014 | Tischler et al. | |

FOREIGN PATENT DOCUMENTS

| | | | | | |
|---|---|---|---|---|---|
| CN | 106499985 | A | | 3/2017 | |
| GB | 1299703 | A | * | 12/1972 | D04D 7/105 |
| GB | 2543750 | A | * | 5/2017 | F21S 4/24 |
| GB | 2543750 | A | | 5/2017 | |
| LV | 11956 | B | * | 4/1998 | |
| WO | 2011100195 | A1 | | 8/2011 | |
| WO | 2017005785 | A1 | | 1/2017 | |

* cited by examiner

LED STRIP FOR INDIRECT LIGHT EMISSION

CROSS-REFERENCE TO PRIOR APPLICATIONS

This application is the U.S. National Phase application under 35 U.S.C. § 371 of International Application No. PCT/EP2018/072414, filed on Aug. 20, 2018, which claims the benefit of European Patent Application No. 17187969.5, filed on Aug. 25, 2017. These applications are hereby incorporated by reference herein.

FIELD OF THE INVENTION

The invention relates to a LED strip for indirect light emission.

BACKGROUND OF THE INVENTION

Increasingly more LED strips are used in various lighting applications such as in retail and home. They are also integrated with electronics and have increased functionality such as connectivity etc. LEDs are typically placed on one of the sides of a flexible flat PCB (printed circuit board), which makes such kinds of LED strips very easy to place on almost any kind of support. The slender design of the LED strips, makes them very discrete and practical for various applications. The light emission from the LEDs is in the same direction as they are positioned on the LED strip. The light produced by such LED strips, is therefore direct light emission. These LED strips are therefore a good solution for direct illumination purposes. However, for other applications, such a light emission can be problematic because of it is very directional and can create discomfort for the environment in which the LED strips are placed in. Direct illumination can also be uncomfortable to look into and have a blinding effect for a subject looking at the LED strip. Furthermore, the light is not distributed evenly with direct illumination. In order to alleviate the issues with direct illumination, other products with a configuration having LED strips arranged in a profile or luminaire for obtaining indirect light emission have been designed. However, such products are costly and customization is difficult to realize. Furthermore, the provided luminaires can be cumbersome, whereby the compact and adaptable features of the LED strips are lost.

In view of the above, it is thus a challenge to design LED strips for providing indirect light emission.

SUMMARY OF THE INVENTION

It is an object of the present invention to overcome this problem, and to provide LED strips capable of providing indirect light emission in a simple and cost effective way, without taking to much space.

According to a first aspect of the invention, this and other objects are achieved by providing a LED strip for providing indirect light emission having an upper surface and a lower surface opposite to the upper surface, the LED strip comprising a plurality of LEDs arranged on the upper surface, wherein the LED strip has an unfolded state and a folded state, the LED strip being substantially planar in the unfolded state and extending along a central longitudinal axis, the LED strip has a first side and a second side opposite to the first side, the first and second side being parallel to the central longitudinal axis in the unfolded state, wherein the LED strip in the folded state has a plurality of first loops, each loop of the plurality of first loops having at least one opening and being provided with at least one of the plurality of LEDs, which is configured to emit light towards a reflective interior surface of the loop, whereby at least a portion of the light reflected from the reflective interior surface may exit the at least one opening of each loop of the plurality of first loops, thereby providing indirect light emission.

The central longitudinal axis is defined as the axis running lengthwise of the LED strip and placed centrally such that it forms a symmetry axis of the LED strip. Thereby a LED strip is provided capable of producing indirect light emission in a simple and effective way. This allows the LED strip to be used in any environment and for any application where indirect light emission is preferable.

By providing the LED strips in a first unfolded state, the LED strips can be packed in a very compact way, which makes it possible to facilitate their transport and packaging. The folded state of the LED strip can be achieved at the desired moment for the user, which makes the LED strips flexible to use. The LED strip may in the folded state have one or more loops that are not provided with a LED.

In an embodiment the LED strip in the folded state has a plurality of loops, wherein the plurality of first loops constitute at least 60% of the plurality of loops, preferably the plurality of first loops constitute at least 80% of the plurality of loops, more preferably the plurality of first loops constitute at least 90% of the plurality of loops e.g. the plurality of first loops may constitute 100% of the plurality of loops.

In an embodiment the reflective interior surface may have a reflectivity of at least 30%, more preferably of at least 40%, and most preferably of at least 50%. The reflectivity may for example be of 80%. The reflective interior surface may be partly transmissive. The reflective interior surface may for example be translucent by having scattering particles as aluminum oxide ($Al_2O_3$), barium sulfate ($BaSO_4$), and/or titanium oxide ($TiO_2$) in a transparent matrix support as silicone, PET, PC, or PMMA. In a further embodiment the reflective interior surface may be specular reflective, however still transparent. For example a thin layer of reflective material, such as aluminum may be applied on a surface substrate, whereby the layer would be reflective, however thin enough to be substantially transparent.

The LEDs may be evenly or homogeneously distributed, such that homogeneous light distribution may be obtained along the LED strip.

In an embodiment a part of the lower surface of the LED strip is for attaching the LED strip to a surface, wherein the LED strip for each loop of the plurality of first loops is provided with a first cut extending from the first side and configured to receive the second side in the folded state such that a loop is created with the upper surface forming the reflective interior surface.

By providing the LED strip with parts for attaching the LED strip to a surface, it is made possible to attach the LED strips to any suitable support surface. Furthermore, the provided cut for each loop, allows the LED strip to be folded in an easier way and to keep the shape of the loop in a substantially locked position.

In an embodiment the LED strip for each loop of the plurality of first loops is provided with a second cut extending from the second side, the first cut is configured to receive the second cut in the folded state such that a loop is created with the upper surface forming the reflective interior surface.

By providing the LED strip with a second cut configured to engage with a first cut, the created loop in the folded state is substantially locked in a further secured position. Furthermore, it allows the first and second cuts to be smaller and not extend as much, while still having a locked position.

In an embodiment the LED strip has a width W perpendicular to the central longitudinal axis, wherein the first cut extends in the direction perpendicular to the central longitudinal axis a distance d1 into the LED strip, and the second cut extends in the direction perpendicular to the central longitudinal axis a distance d2 into the LED strip, wherein the sum of d1 and d2 substantially equals W.

Thereby a LED strip having loops not exceeding the width of the LED strip in the folded state, is provided. By providing the LED strip with first and second cuts extending such that the sum of their distance equals the width W of the LED strip, the loops are not exceeding the width of the LED strip in the folded state.

In an embodiment at least one loop has a starting portion and an ending portion, the first side of the starting portion being arranged adjacent to the second side of the ending portion in the folded state such that a loop is created with the upper surface forming the reflective interior surface.

The first side of the starting portion may abut the second side of the ending portion.

In an embodiment according to the invention, each loop of the plurality of first loops has a starting portion and an ending portion, wherein for each loop the first side of the starting portion is being arranged adjacent to the second side of the ending portion in the folded state such that a loop is created with the upper surface forming the reflective interior surface.

Thereby a LED strip having loops that are shifted a width W for each loop is provided, such than the LED strip is substantially slanted with respect to the central longitudinal axis L.

In an embodiment each loop of the plurality of first loops has a starting portion and an ending portion, wherein for every second loop the first side of the starting portion is being arranged adjacent to the second side of the ending portion in the folded state, and for the remaining loops the second side of the starting portion is being arranged adjacent to the first side of the ending portion in the folded state, such that a central axis of the LED strip in the folded state, is parallel with the central longitudinal axis of the LED strip in the unfolded state.

Thereby a LED strip having loops that are shifted a width W is provided, such that the LED strip is substantially straight.

In an embodiment of the invention the LED strip comprises a plurality of adhesive portions, on the upper or lower surface.

In an embodiment of the invention the adhesive portions are equally distributed over at least a part of the LED strip with a distance d5 between two neighboring adhesive portions in the unfolded state.

The distance d5 is defined as the shortest distance between two neighboring adhesive portions, as shown in FIG. 24*b*.

In an embodiment of the invention the distance d5 is larger or equal to the circumference of one loop in the folded state.

In an embodiment of the invention the distance d5 is smaller or equal to the distance between the middle of two neighboring LEDs in the unfolded state.

In an embodiment of the invention the plurality of adhesive portions are protected by a removable film, arranged to be removed to unveal the at least one adhesive portion.

The adhesive portion may be of glue, and different types of glues may be used depending on the support surface.

The adhesive portion being arranged such as to be in contact with a support surface in the folded state.

In an embodiment of the invention at least one loop of the plurality of first loops has a plurality of LEDs.

Thereby more light may be reflected by the reflective inside of the loops, and it may be reflected in different directions and with different angles.

In an embodiment of the invention at least two of the plurality of LEDs are of different colors or color temperature.

The plurality of LEDs may be RGB LEDs, such that by blending different colors any color combination may be provided.

Different colors may be provided to create different atmospheres in an environment with different color temperatures.

In an embodiment a part of the upper surface of the LED strip is for attaching the LED strip to a surface, each loop is provided with at least two pre-bended portions, the at least two pre-bended portions being spaced apart by a distance d3 in an unfolded state and with a distance d4 in a folded state, wherein d4 is less than 25% of d3, preferably less than 10%, such that a loop is created with the upper surface forming the reflective interior surface.

The pre-bended portions allow to provide loops without having to flip over the LED strip, such that the upper surface of the LED strip forms the reflective interior surface of the loop.

According to a second aspect the invention relates to a system comprising a first LED strip according to the previous embodiment and a second strip for attaching to a part of the upper surface of the first LED strip, when the first LED strip is in folded state, for stabilizing the first LED strip.

In an embodiment the second strip is a second LED strip, comprising a plurality of LEDs, for each loop of the plurality of first loops of the first LED strip, the first pre-bended portion and the second pre-bended portion abut a LED of the plurality of LEDs of the second LED strip.

Thereby a plurality of LEDs is provided in each loop of the plurality of first loops, whereby more light may be reflected by the reflective inside of the loops. Furthermore, light may be reflected in different directions and with different angles.

In an embodiment a luminaire or light fitting comprising a LED strip according to the invention being arranged in the folded state, such that the luminaire or light fitting provides indirect light emission.

The luminaire may be a light bulb or any type of light fixture.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1A:
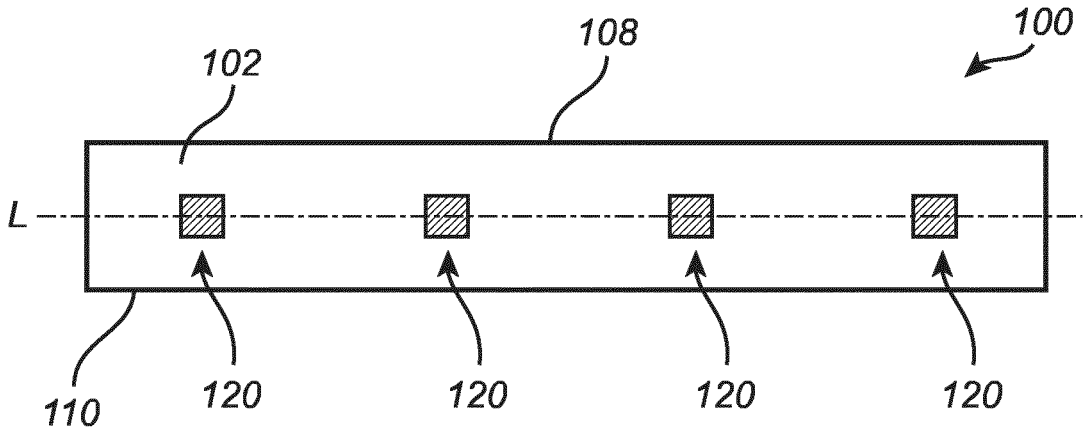
FIG. 1*a* shows a top-side view of a LED strip in an embodiment according to the invention in the unfolded state with a plurality of LEDs, where the central longitudinal axis is shown.
Figure 1B:
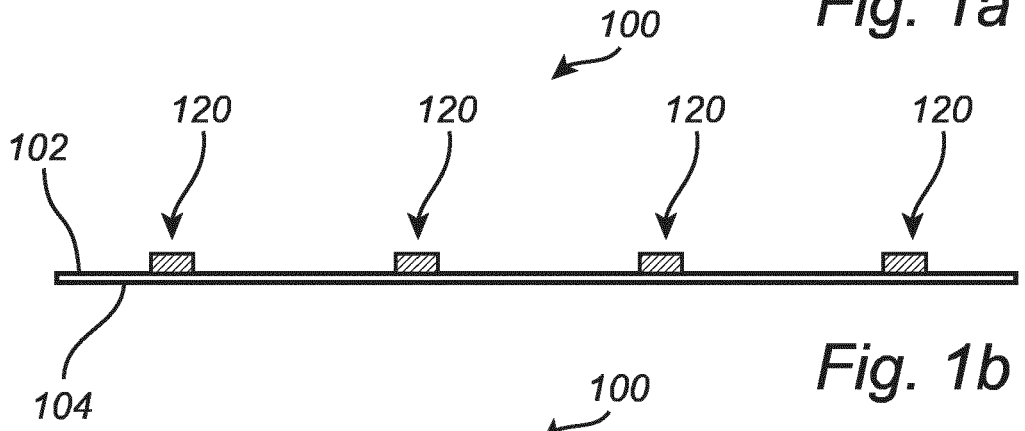
FIG. 1*b* shows a side-view of the LED strip shown in FIG. 1.

FIG. 1*a* shows a top-side view of an embodiment of a LED strip 100 according to the invention in the unfolded state with a plurality of LEDs 120, where the central longitudinal axis L is shown. The LED strip 100 for providing indirect light emission according to the invention generally comprises an upper surface 102 and a lower surface 104 opposite to the upper surface 102. The LED strip 100 further comprises a plurality of LEDs 120 arranged on the upper surface 102. The LED strip 100 has an unfolded state shown in FIGS. 1*a* and 1*b* and a folded state shown in FIGS. 2*a* and 2*b*. The LED strip 100 is substantially planar in the unfolded state and extends along a central longitudinal axis L. The LED strip has a first side 108 and a second side 110 opposite to the first side 108, the first and second side 108 and 110 being parallel to the central longitudinal axis L in the unfolded state.

Figure 2A:
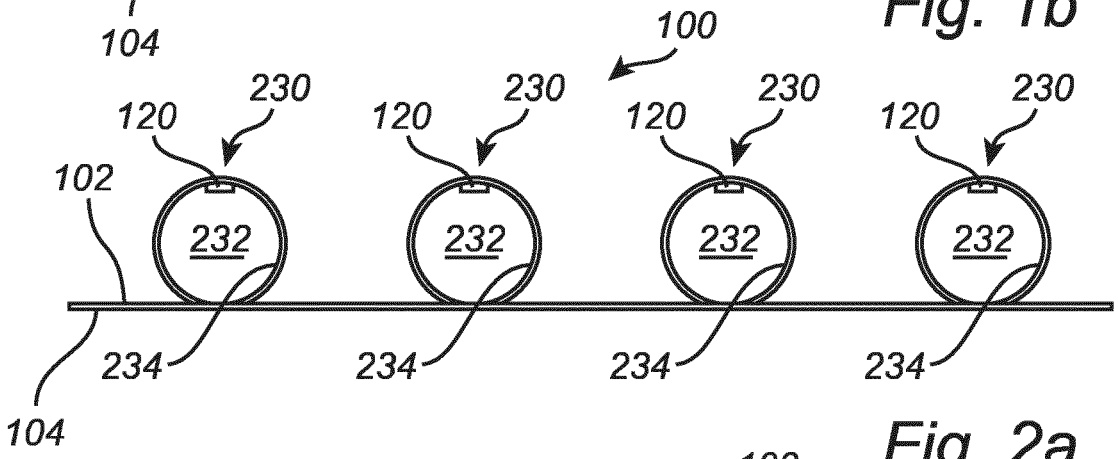
FIG. 2*a* shows a side-view of a LED strip according to the invention in the folded state, in an embodiment comprising a plurality of first loops, each loop having at least one opening and being provided with a plurality of LEDs.
Figure 2B:
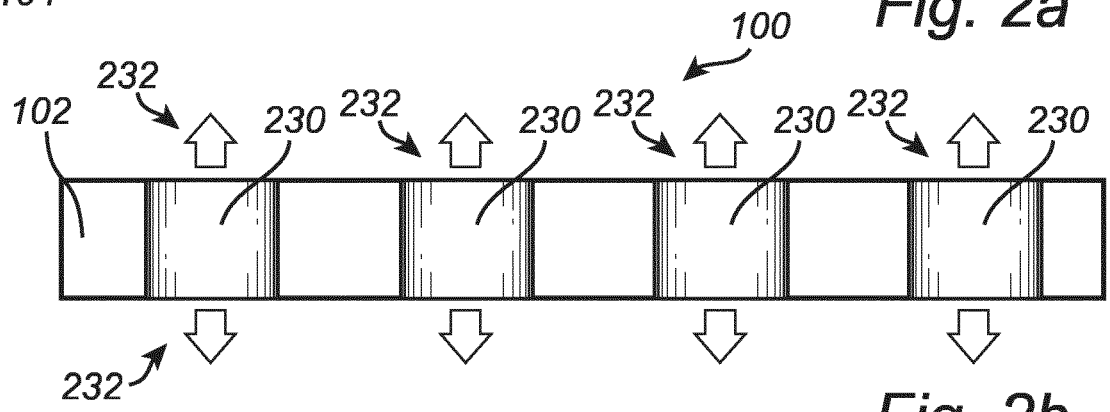
FIG. 2*b* shows a top-side view of the LED strip shown in FIG. 2*a*, in an embodiment where light exits the openings on each side of the loops.

The LED strip 100 comprises in the folded state a plurality of first loops 230, as can be seen in FIG. 2*a*. Each loop 230 of the plurality of loops have at least one opening 232 and is provided with at least one of the plurality of LEDs 120, which is configured to emit light towards a reflective interior surface 234 of the loop 230. At least a portion of the light reflected from the reflective interior surface 234 may exit the at least one opening 232 of each loop 230. Thereby, indirect light emission is provided.

Figure 3:
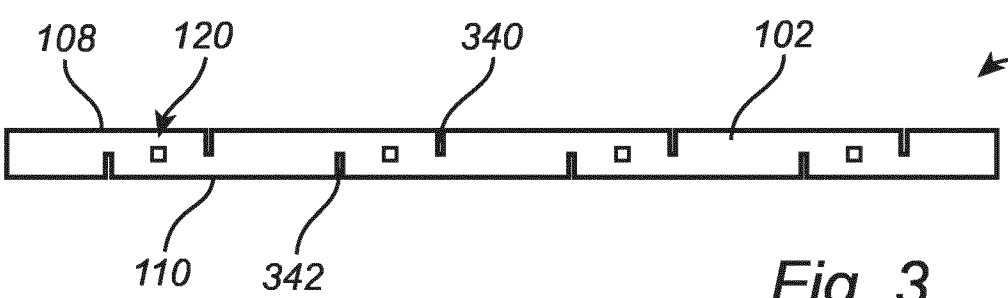
FIG. 3 shows a top-side view of a LED strip according to the invention in the unfolded state with a plurality of LEDs, in an embodiment comprising first and second cuts extending respectively from the first and second sides.
Figure 4:
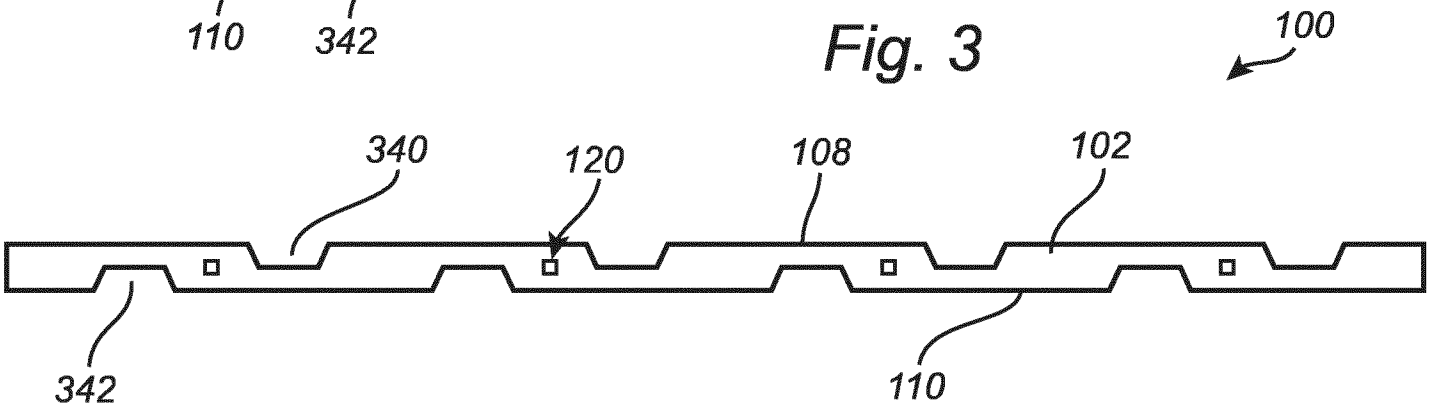
FIG. 4 shows a top-side view of a LED strip according to the invention in the unfolded state with a plurality of LEDs, in an embodiment comprising another type of first and second cuts extending respectively from the first and second sides.
Figure 5:
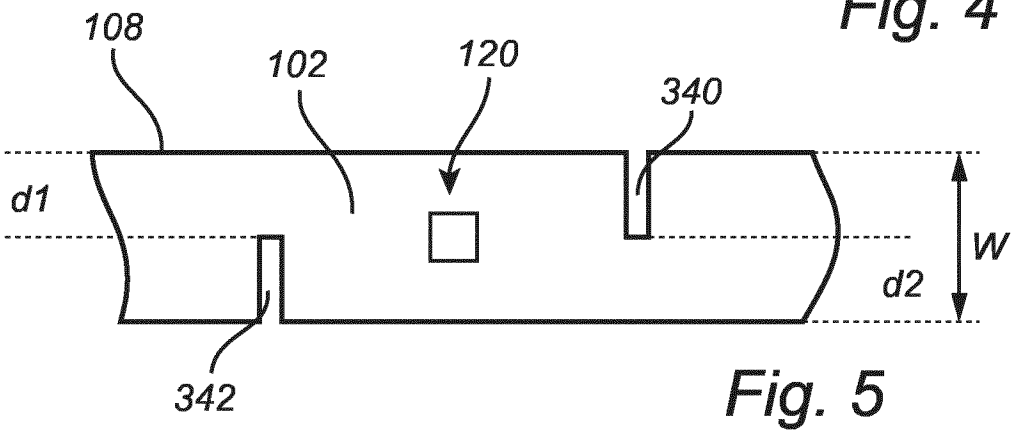
FIG. 5 shows a top-side view of a portion of the LED strip shown in FIG. 3, showing dimensions of the strip.

In an embodiment shown in FIGS. 3, 4 and 5 a part of the lower surface 104 of the LED strip 100 is for attaching the LED strip to a surface (not shown). The LED strip 100 is provided for each loop of the plurality of first loops 230 with a first cut 340 extending from the first side 108 and configured to receive the second side 110 in the folded state, such that a loop 230 is created with the upper surface 102 forming the reflective interior surface 234.

In an embodiment the LED strip 100 is provided for each loop 230 of the plurality of first loops 230 with a second cut 342 extending from the second side 110. The first cut 340 is configured to receive the second cut 342 in the folded state such that a loop 230 is created with the upper surface 102 forming the reflective interior surface 232.

In an embodiment of the invention, FIG. 5 shows a top-side view of a portion of the LED strip shown in FIG. 3, showing dimensions of the strip. The LED strip 100 has a width W perpendicular to the central longitudinal axis L. The first cut 340 extends in the direction perpendicular to the central longitudinal axis L a distance d1 into the LED strip 100, and the second cut 342 extends in the direction perpendicular to the central longitudinal axis L a distance d2 into the LED strip 100. The sum of d1 and d2 equals W.

Figure 6:
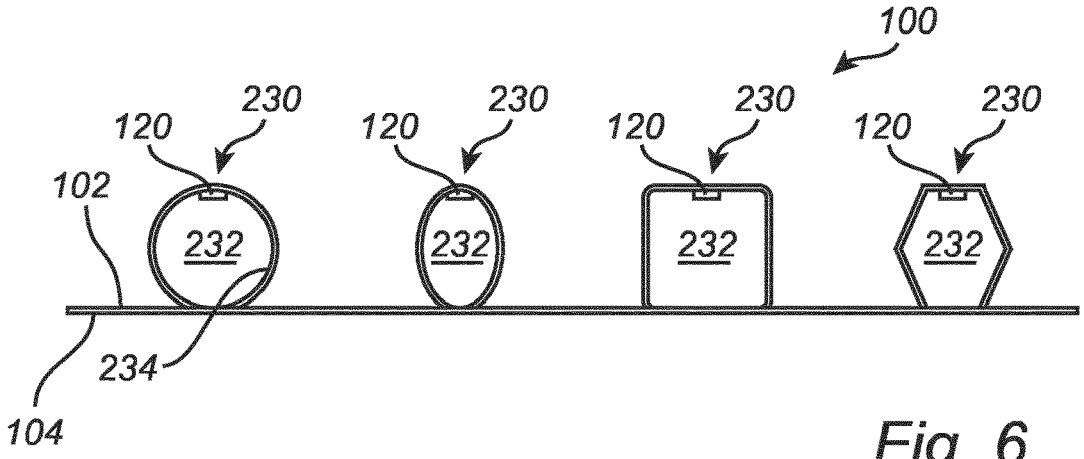
FIG. 6 shows a side-view of a LED strip according to the invention in the folded state, in an embodiment comprising a plurality of first loops of different shapes.

FIG. 6 shows a side-view of a LED strip 100 according to the invention in the folded state, in an embodiment comprising a plurality of first loops 230 of different shapes. The shape of the loops 230 can be circular, oval, squared or hexagonal.

Figure 7:
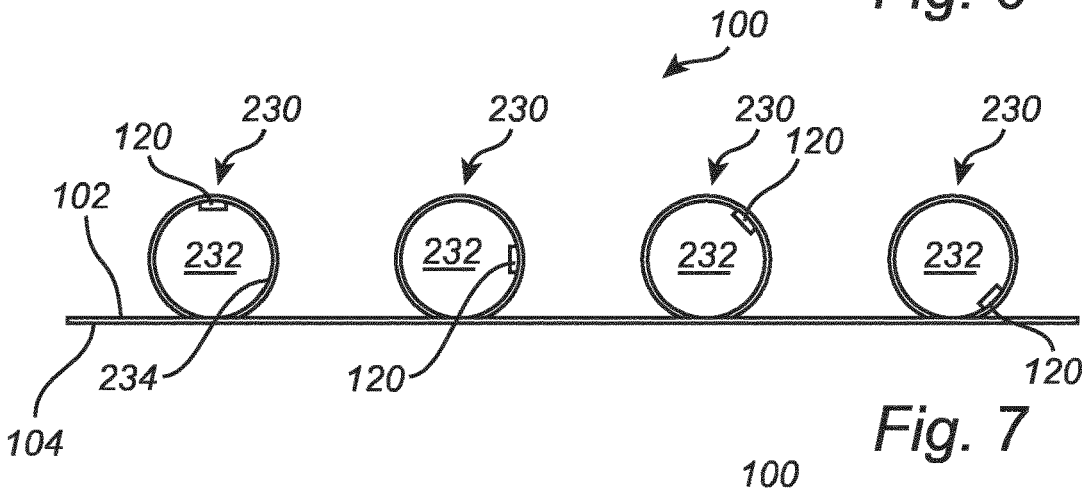
FIG. 7 shows a side-view of a LED strip according to the invention in the folded state, in an embodiment comprising a plurality of first loops having LEDs positioned at different places inside the loops.

FIG. 7 shows a side-view of a LED strip 100 according to the invention in the folded state, in an embodiment comprising a plurality of first loops 230 having a plurality of LEDs 120 positioned at different places inside the loops. The different positions of the LEDs 120 makes it possible to reflect the light in different angles and create a different illumination.

Figure 8A:
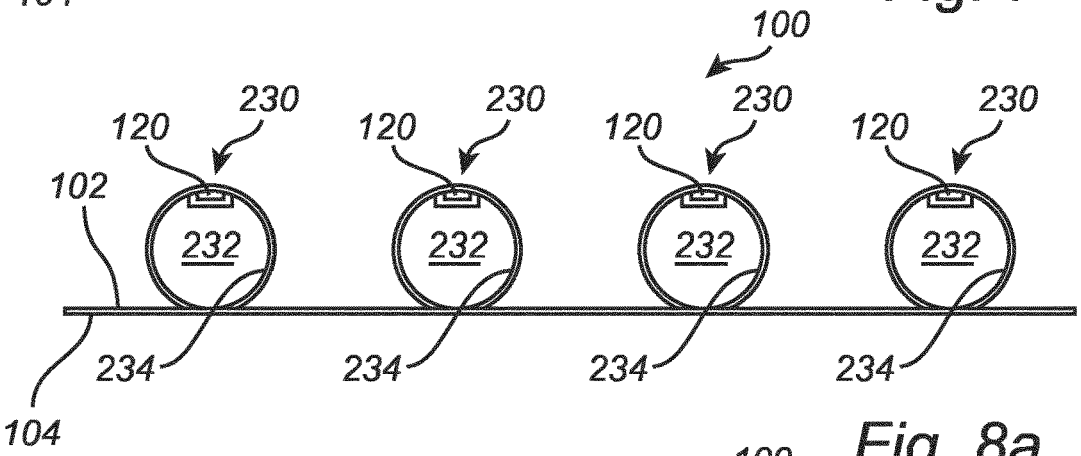
FIG. 8*a* shows a side-view of a LED strip according to the invention in the folded state, in an embodiment comprising a plurality of first loops comprising side emitting LEDs.

FIG. 8*a* shows a side-view of a LED strip 100 according to the invention in the folded state, in an embodiment comprising a plurality of first loops 230 comprising side emitting LEDs 120.

Figure 8B:
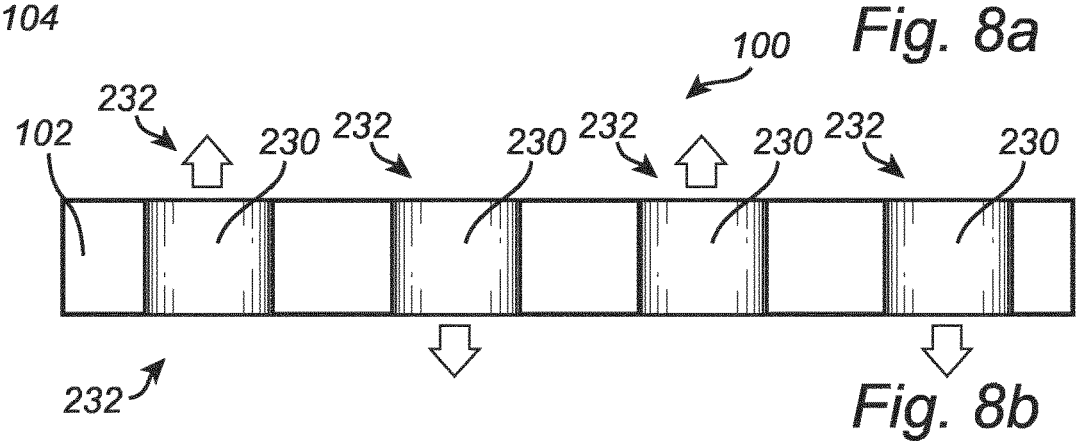
FIG. 8*b* shows a top-side view of the LED strip shown in FIG. 8*a*, in an embodiment where the light emitted from the side emitting LEDs exits different openings of the loops.

In FIG. 8*b* a top-side view of the LED strip 100 shown in FIG. 8*a* is shown, in an embodiment where the light emitted from the side emitting LEDs 120 exits different openings 232 of the loops 230.

Figure 9:
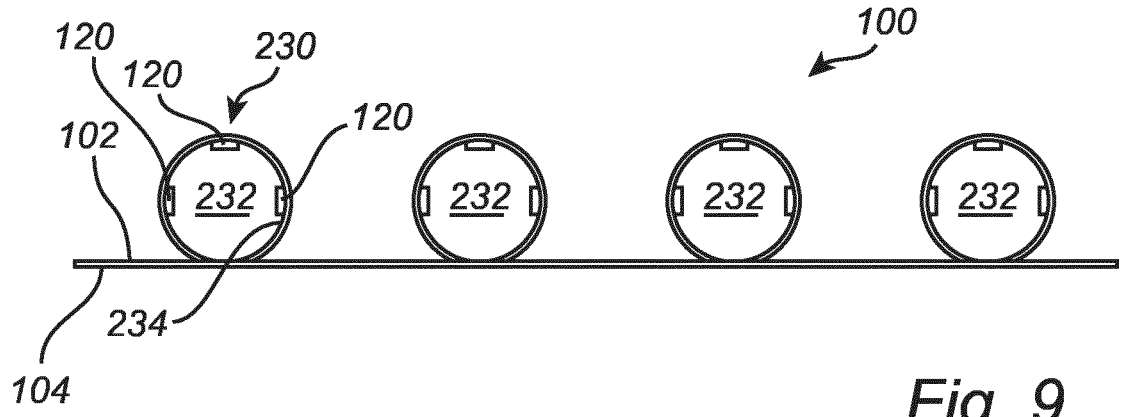
FIG. 9 shows a side-view of a LED strip according to the invention in the folded state, in an embodiment comprising a plurality of first loops comprising a plurality of LEDs in each loop.

In an embodiment of the invention shown in FIG. 9 at least one loop of the plurality of first loops 230 has a plurality of LEDs.

Thereby more light may be reflected by the reflective interior surface 234 of the loops 230, and it may be reflected in different directions and with different angles.

Figure 10:
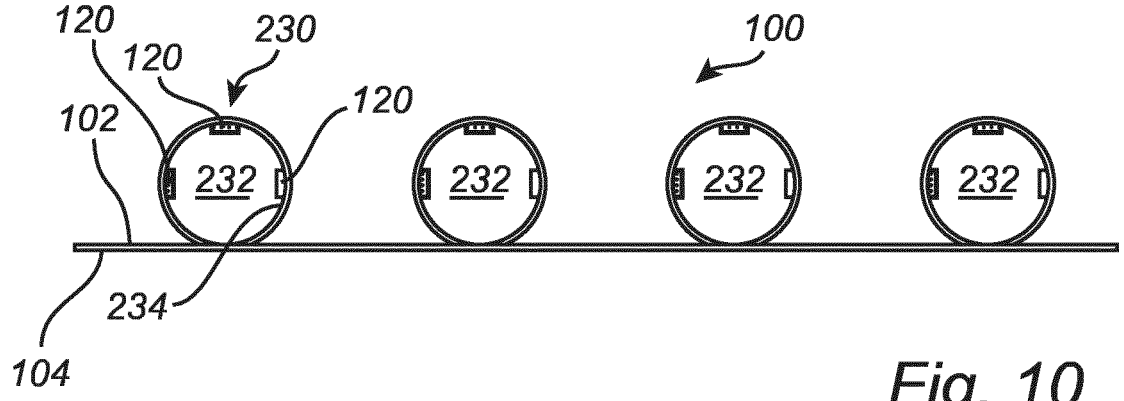
FIG. 10 shows the LED strip shown in FIG. 9, in an embodiment where the plurality of LEDs in each first loop are of different colors.

In an embodiment shown in FIG. 10 the LED strip 100 shown in FIG. 9 the plurality of LEDs 120 in each first loop 230 are of different colors or color temperatures.

The plurality of LEDs may be RGB LEDs, such that by blending different colors any color combination may be provided.

Figure 11:
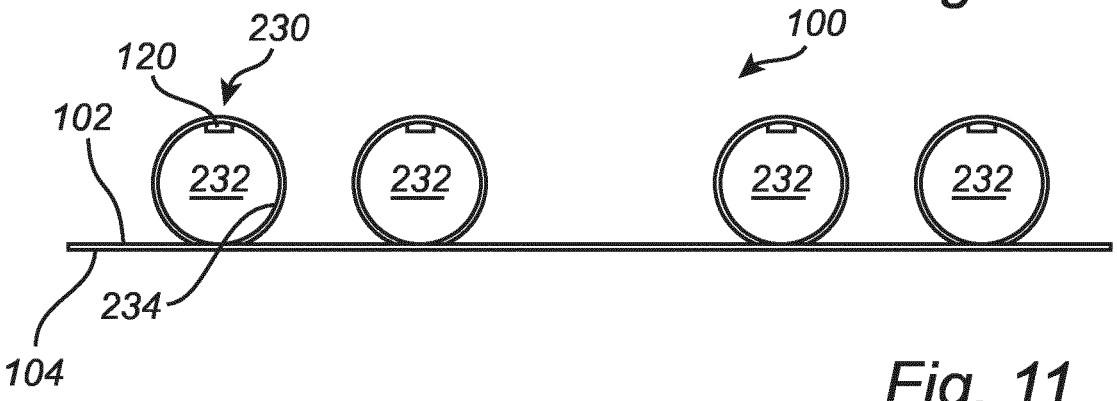
FIG. 11 shows a side-view of a LED strip according to the invention in the folded state, in an embodiment comprising a plurality of first loops where the loops are arranged with varying pitch.

FIG. 11 shows a side-view of a LED strip 100 according to the invention in the folded state, in an embodiment comprising a plurality of first loops 230, where the loops 230 are arranged with a varying pitch.

Figure 12:
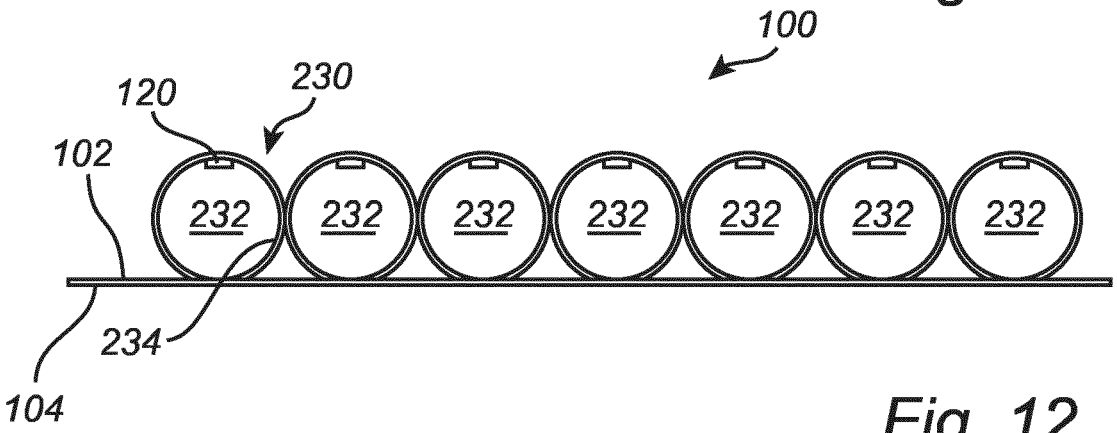
FIG. 12 shows a side-view of a LED strip according to the invention in the folded state, in an embodiment comprising a plurality of first loops where the loops are arranged with varying pitch, such that the loops are in contact with eachother.

FIG. 12 shows a side-view of a LED strip 100 according to the invention in the folded state, in an embodiment comprising a plurality of first loops 230 where the loops 230 are arranged with a pitch, such that the loops 230 are in contact with each other.

Figure 13:
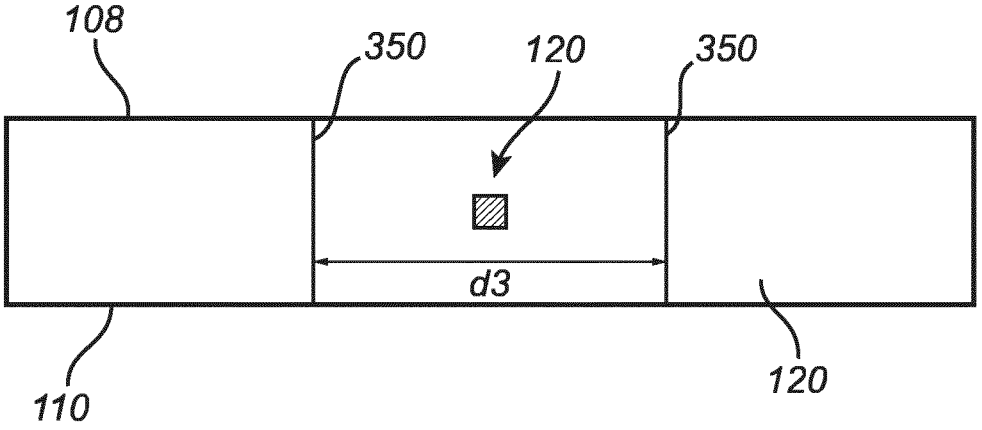
FIG. 13 shows a top-side view of a portion of a LED strip in an embodiment according to the invention in the unfolded state, where the pre-bended portions are shown.
Figure 14:
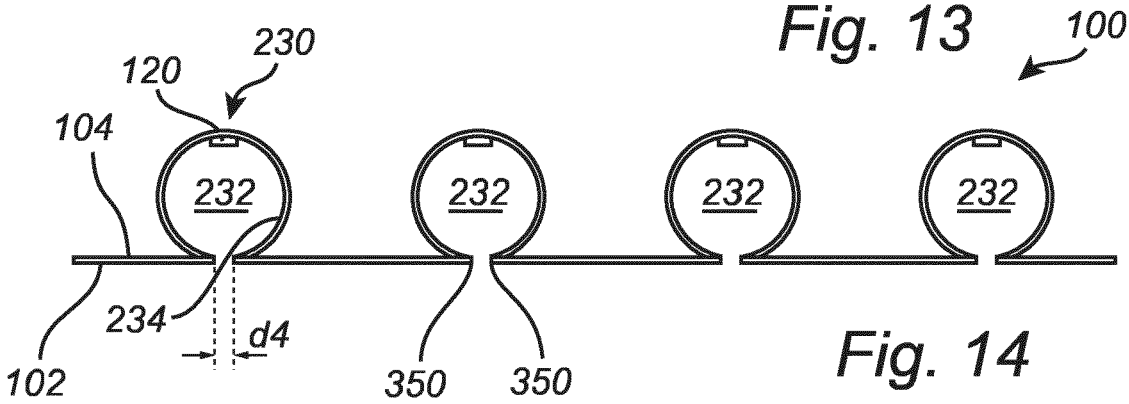
FIG. 14 shows a side-view of a LED strip according to the invention in the folded state, in an embodiment comprising pre-bended portions, where a part of the upper surface of the LED strip is for attaching the LED strip.

In an embodiment, a part of the upper surface 102 of the LED strip 100 is for attaching the LED strip 100 to a surface (not shown). Each loop 230 of the plurality of first loops is provided with two pre-bended portions 350 that are spaced apart by a distance d3 in an unfolded state, shown in FIG. 13 and with a distance d4 in a folded state, shown in FIG. 14. d4 is less than 25% of d3, preferably less than 10%, such that a loop 230 is created with the upper surface 102 forming the reflective interior surface 234 as can be seen in FIG. 14.

Figure 17:
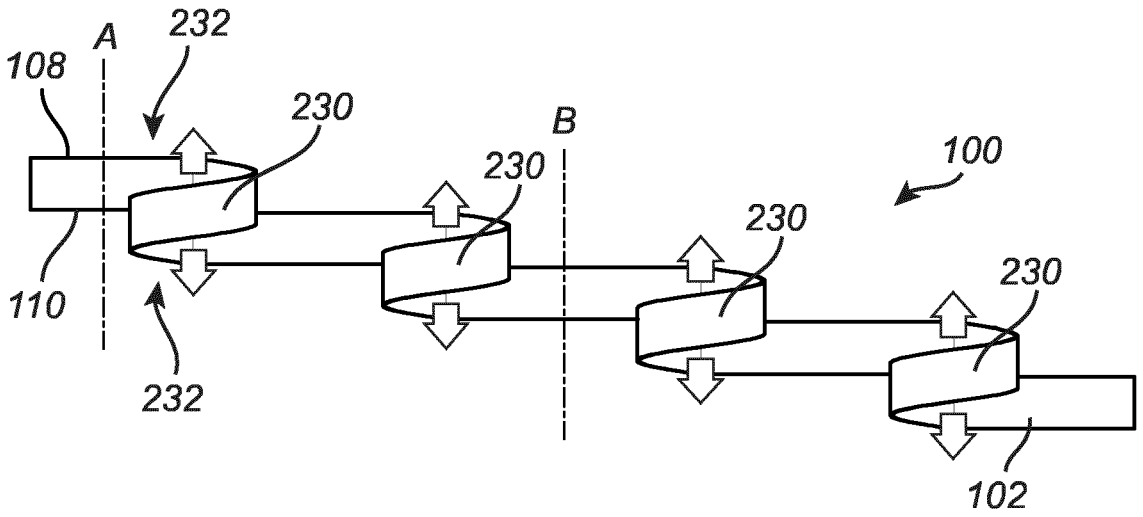
FIG. 17 shows a top-side view of a LED strip in an embodiment according to the invention in the folded state with a plurality of loops, where each first loop of the plurality of first loops has a starting portion and an ending portion, wherein for each loop the first side of the starting portion is being arranged adjacent to the second side of the ending portion in the folded state, such that a loop is created with the upper surface forming the reflective interior surface. Thereby a LED strip having loops that are shifted a width W for each loop is provided, such that the LED strip is substantially slanted with respect the central longitudinal axis L.
Figure 18:
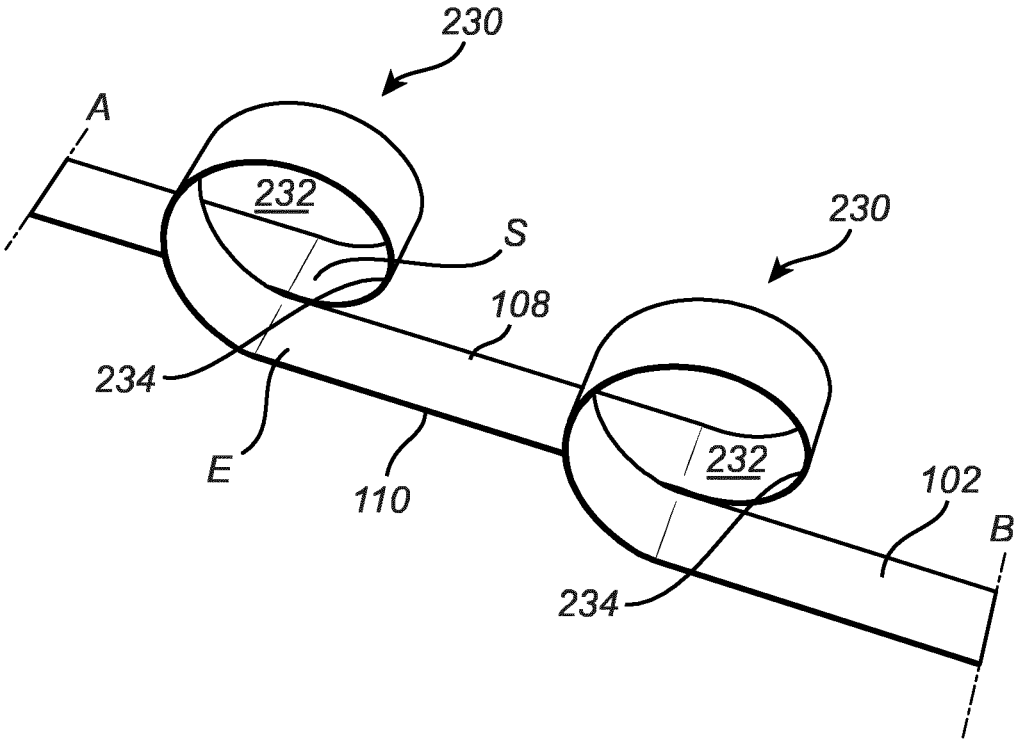
FIG. 18 shows a perspective view of a portion from A to B of the LED strip shown in FIG. 17, where the starting portion and the ending portion of a loop are shown.

In an embodiment of the invention shown in FIG. 17 and FIG. 18, each loop 230 of the plurality of first loops 230 has a starting portion S and an ending portion E. For each loop 230, the first side 108 of the starting portion S is arranged adjacent to the second side 110 of the ending portion E in the folded state, such that a loop 230 is created with the upper surface 102 forming the reflective interior surface 234.

Thereby a LED strip 100 having loops 230 that are shifted a width W for each loop 230 is provided, such that the LED strip 100 is substantially slanted with respect the central longitudinal axis L.

Figure 19:
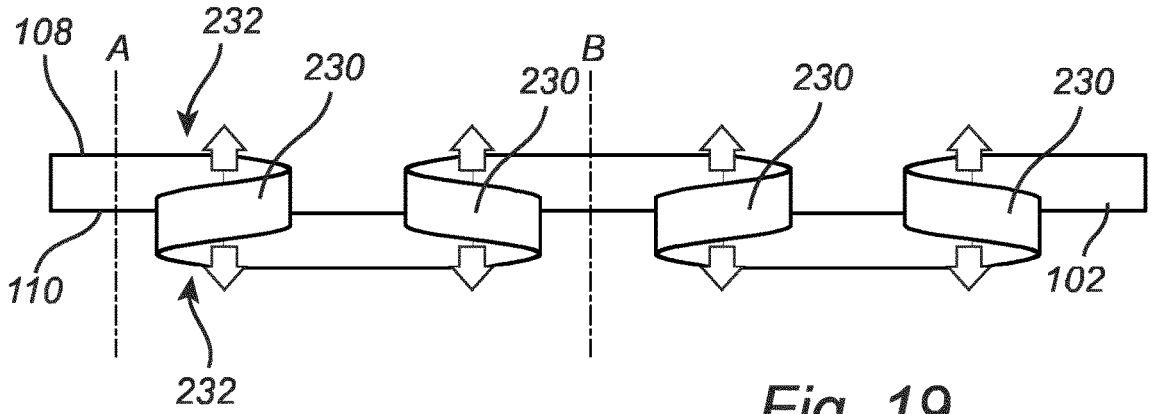
FIG. 19 shows a top-side view of a LED strip in an embodiment according to the invention in the folded state with a plurality of first loops having a starting portion and an ending portion, wherein for every second loop the first side of the starting portion is arranged adjacent to the second side of the ending portion in the folded state, and for the remaining loops the second side of the starting portion is arranged adjacent to the first side of the ending portion in the folded state, such that a central axis of the LED strip in the folded state, is parallel with the central longitudinal axis of the LED strip in the unfolded state.
Figure 20:
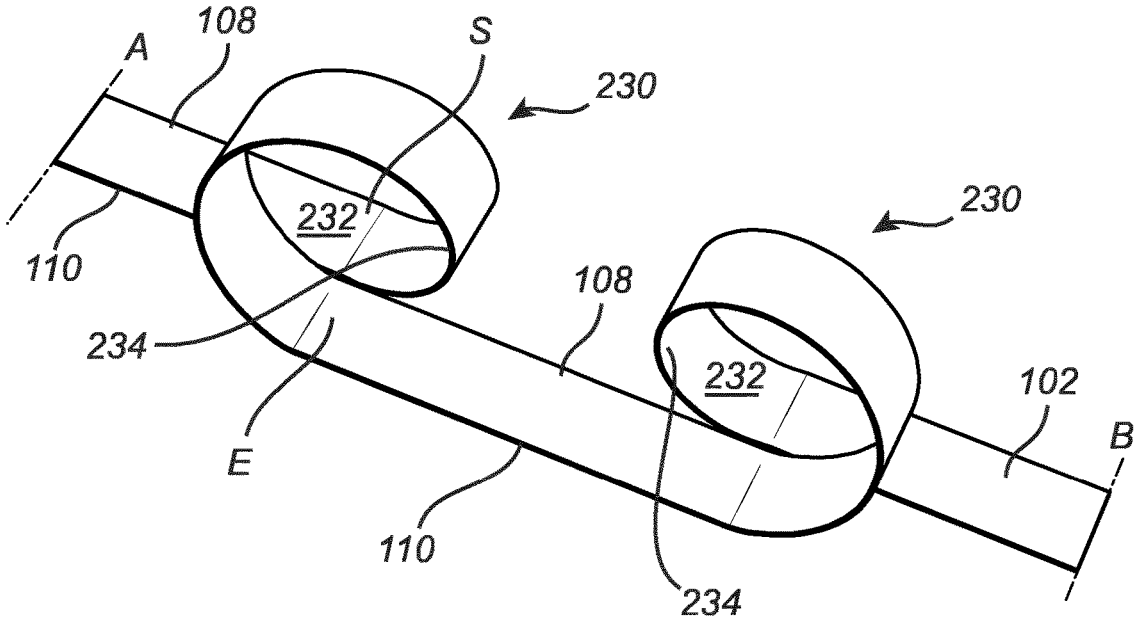
FIG. 20 shows a perspective view of a portion from A to B of the LED strip shown in FIG. 19, where the starting portion and the ending portion of a loop are shown.

In an embodiment of the invention shown in FIG. 19 and FIG. 20, each loop 230 of the plurality of first loops 230 has a starting portion S and an ending portion E. For every second loop, the first side 108 of the starting portion S is arranged adjacent to the second side 110 of the ending portion E in the folded state, and for the remaining loops the second side 110 of the starting portion S is arranged adjacent to the first side 108 of the ending portion E in the folded state, such that a central axis of the LED strip in the folded state, is parallel with the central longitudinal axis L of the LED strip 100 in the unfolded state.

Thereby a LED strip 100 having loops 230 that are shifted a width W is provided, such that the LED strip is substantially straight.

Figure 15:
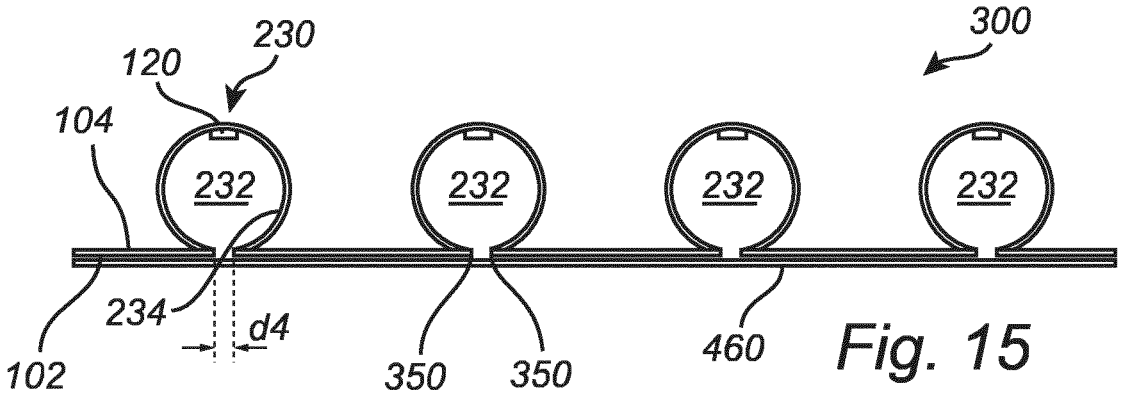
FIG. 15 shows a side-view of the system according to a second aspect of the invention, in an embodiment comprising a first LED strip according to the first aspect of the invention and a second strip attached to a part of the upper surface of the first LED strip, for stabilizing the first LED strip.
Figure 16:
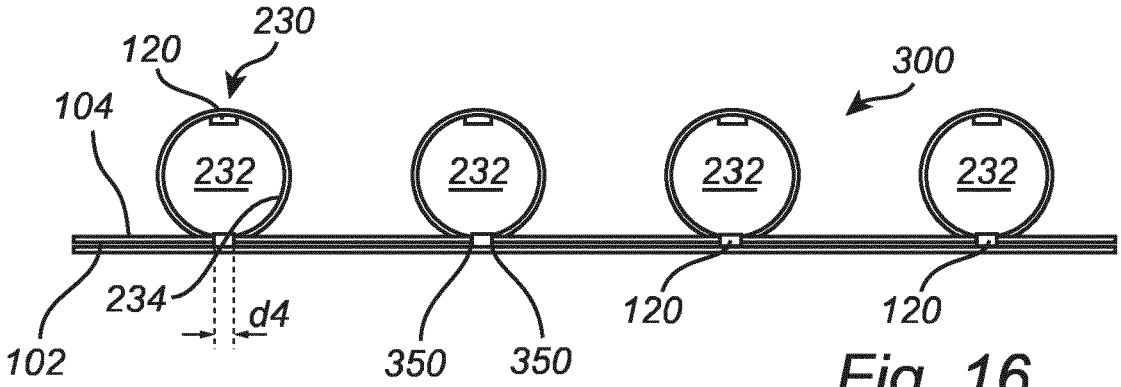
FIG. 16 shows the system shown in FIG. 9, in an embodiment where the second strip comprises a plurality of LEDs, and for each loop of the plurality of first loops of the first LED strip, the first pre-bended portion and the second pre-bended portion abut a LED of the plurality of LEDs of the second LED strip.

According to an embodiment of the second aspect of the invention shown in FIGS. 15 and 16, there is provided a system 300 comprising a first LED strip 100 according to the embodiment shown in FIG. 14, and a second strip 460 attached to a part of the upper surface 102 of the first LED strip 100, when the first LED strip 100 is in folded state, for stabilizing the first LED strip 100.

In an embodiment of the invention shown in FIG. 16 the second strip 460 is a second LED strip 460, comprising a plurality of LEDs 120. The first pre-bended portion 350 and the second pre-bended portion 350 abut a LED 120 of the plurality of LEDs of the second LED strip 460.

Thereby a plurality of LEDs 120 is provided in each first loop, whereby more light may be reflected by the reflective interior surface 234 of the loops 230. Furthermore, light may be reflected in different directions and with different angles.

Figure 24A:
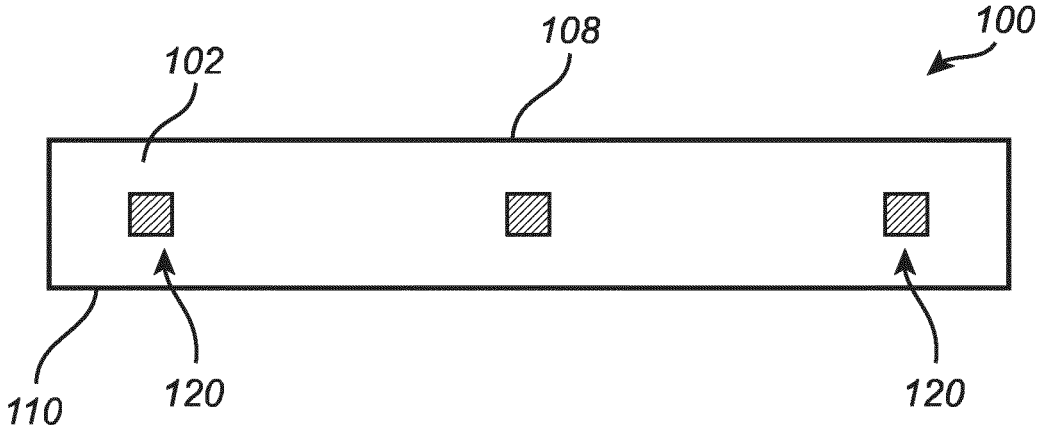
FIG. 24*a* shows a top-side view of the upper surface of a LED strip according to an embodiment of the invention in the unfolded state with a plurality of LEDs.
Figure 24B:
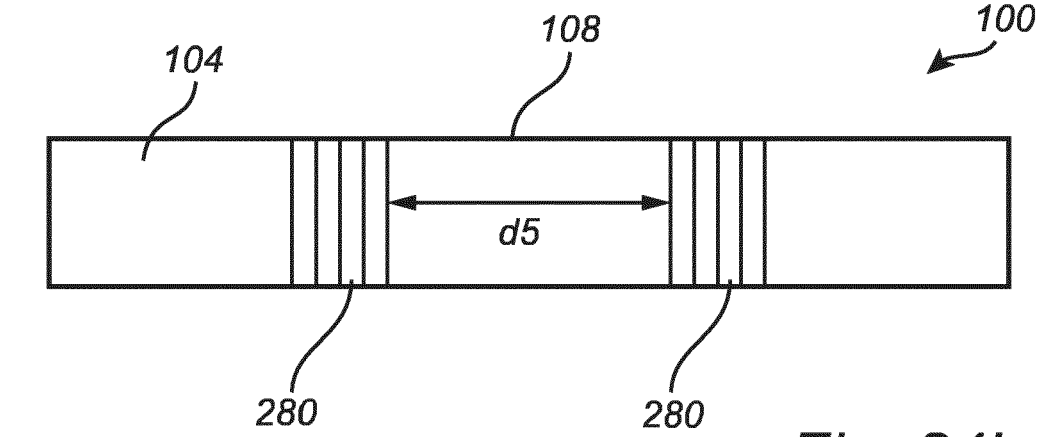
FIG. 24*b* shows a top-side view of the lower surface of a LED strip according to an embodiment of the invention in the unfolded state with a plurality of adhesive portions.
Figure 24C:
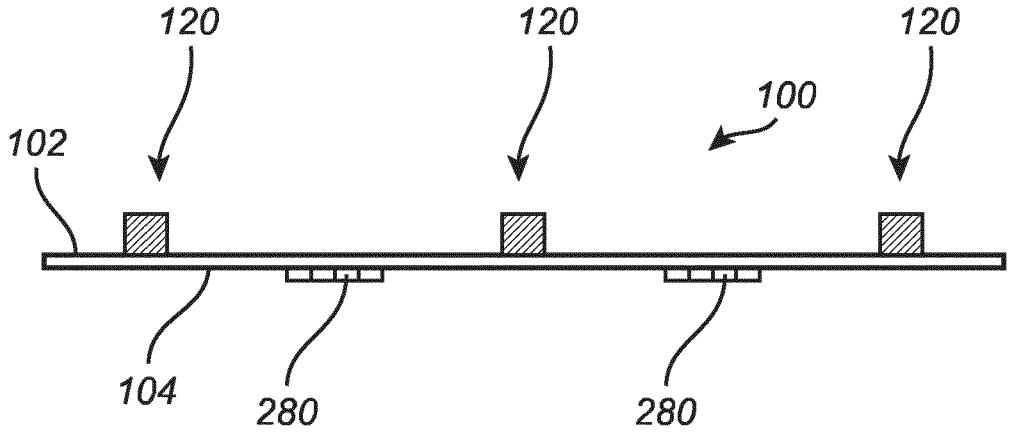
FIG. 24*c* shows a side-view of the LED strip shown in FIG. 24*b*.

In an embodiment of the invention shown in FIGS. 24*a*, 24*b*, and 24*c* the LED strip 100 comprises a plurality of adhesive portions 280, on the lower surface 104.

FIG. 24*a* shows the upper surface 102 of a LED strip 100 according to an embodiment of the invention in the unfolded state with a plurality of LEDs 120.

FIG. 24*b* shows the lower surface 104 of a LED strip 100 according to an embodiment of the invention in the unfolded state with a plurality of adhesive portions 280.

FIG. 24*c* shows a side-view of the LED strip 100 shown in FIGS. 24*a* and 24*b*, where both the LEDs 120 and the adhesive portions 280 can be seen.

In an embodiment of the invention the adhesive portions 280 are equally distributed over at least a part of the LED strip 100, with a distance d5 between two neighboring adhesive portions 280 in the unfolded state. The distance d5 is defined as the shortest distance between two neighboring adhesive portions 280, as shown in FIG. 24*b*.

In an embodiment of the invention the distance d5 is larger or equal to the circumference of one loop 230 in the folded state.

In an embodiment of the invention the distance d5 is smaller or equal to the distance between the middle of two neighbouring LEDs 120 in the unfolded state.

In an embodiment of the invention the plurality of adhesive portions 280 are protected by a removable film (not shown), arranged to be removed to unveal the adhesive portions 280.

Figure 21:
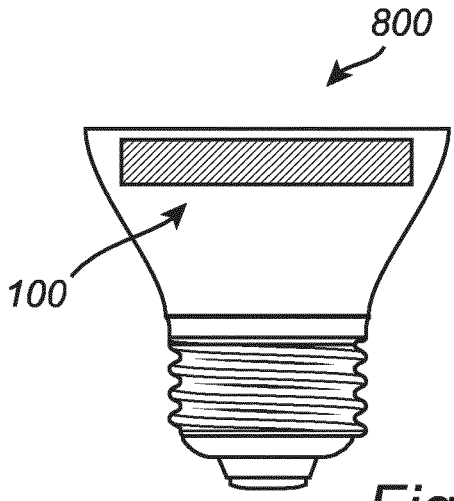
FIG. 21 shows a schematic view of a light bulb comprising a LED strip according to an embodiment of the invention.
Figure 22:
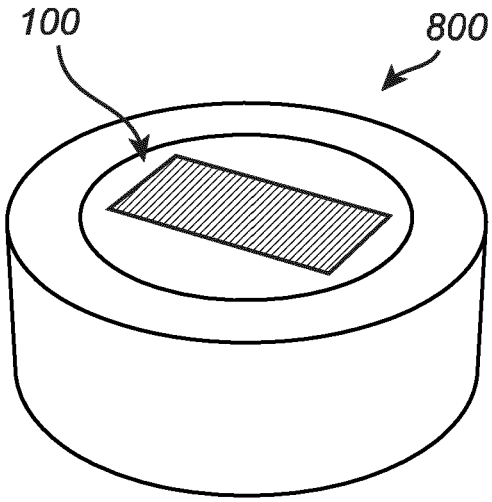
FIG. 22 shows a schematic view of a light engine comprising a LED strip according to an embodiment of the invention.
Figure 23:
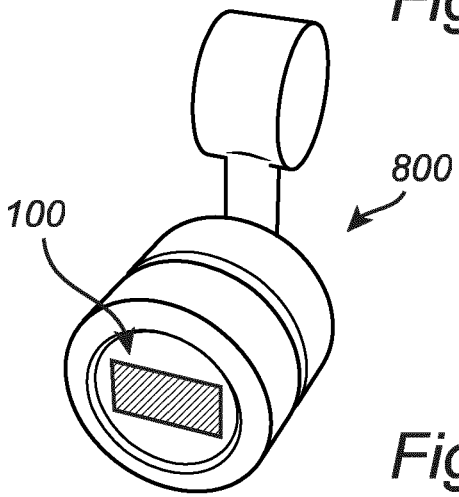
FIG. 23 shows a schematic view of a luminaire comprising a LED strip according to an embodiment of the invention.

In an embodiment shown in FIG. 21, FIG. 22, and FIG. 23 a luminaire or light fitting 800 is provided with a LED strip 100 according to the invention, that is arranged in the folded state, such that the luminaire 800 provides indirect light emission.

The invention claimed is:

1. A LED strip for providing indirect light emission having an upper surface and a lower surface opposite to the upper surface, the LED strip comprising a plurality of LEDs arranged on the upper surface, wherein the LED strip has an unfolded state and a folded state, the LED strip being substantially planar in the unfolded state and extending along a central longitudinal axis, the LED strip comprising a first side and a second side opposite to the first side, the first and second side being parallel to the central longitudinal axis (L) in the unfolded state, wherein the LED strip in the folded state has a plurality of first loops, each of the plurality of first loops comprising at least one opening and being provided with at least one of the plurality of LEDs, which is configured to emit light towards a reflective interior surface of the loop, whereby at least a portion of the light reflected from the reflective interior surface may exit the at least one opening of each loop of the plurality of first loops, thereby providing indirect light emission;

wherein a part of the lower surface of the LED strip is for attaching the LED strip to a surface, wherein the LED strip for each loop of the plurality of first loops is provided with a first cut extending from the first side and configured to receive the second side in the folded state, such that a loop is created with the upper surface forming the reflective interior surface.

2. The LED strip according to claim 1, wherein the LED strip for each loop of the plurality of first loops is provided with a second cut extending from the second side, the first cut is configured to receive the second cut in the folded state such that a loop is created with the upper surface forming the reflective interior surface.

3. The LED strip according to claim 1, wherein at least one loop has a starting portion and an ending portion, the first side of the starting portion being arranged adjacent to the second side of the ending portion in the folded state, such that a loop is created with the upper surface forming the reflective interior surface.

4. The LED strip according to claim 1, wherein the LED strip comprises a plurality of adhesive portions, on the upper or lower surface.

5. The LED strip according to claim 1, wherein at least one loop of the plurality of first loops has a plurality of LEDs.

6. The LED strip according to claim 1, wherein a part of the upper surface of the LED strip is for attaching the LED strip to a surface, each loop of the plurality of first loops is provided with at least two pre-bended portions, the at least two pre-bended portions being spaced apart by a distance d3 in an unfolded state and with a distance d4 in a folded state, wherein d4 is less than 25% of d3, such that a loop is created with the upper surface forming the reflective interior surface.

7. A luminaire or light fitting comprising a LED strip or system according to claim 1 being arranged in the folded state, such that the luminaire or light fitting provides indirect light emission.

8. The LED strip according to claim 2, wherein the LED strip has a width W perpendicular to the central longitudinal axis, wherein the first cut extends in the direction perpendicular to the central longitudinal axis a distance d1 into the LED strip, and the second cut extends in the direction perpendicular to the central longitudinal axis a distance d2 into the LED strip, wherein the sum of d1 and d2 substantially equals W.

9. The LED strip according to claim 3, wherein each loop of the plurality of first loops has a starting portion and an ending portion, wherein for each loop the first side of the starting portion is being arranged adjacent to the second side of the ending portion in the folded state, such that a loop is created with the upper surface forming the reflective interior surface.

10. The LED strip according to claim 3, wherein each loop of the plurality of first loops has a starting portion and an ending portion, wherein for every second loop the first side of the starting portion is being arranged adjacent to the second side of the ending portion in the folded state, and for the remaining loops the second side of the starting portion is being arranged adjacent to the first side of the ending portion in the folded state, such that a central axis of the LED strip in the folded state, is parallel with the central longitudinal axis of the LED strip in the unfolded state.

11. The LED strip according to claim 4, wherein the adhesive portions are equally distributed over at least a part of the LED strip with a distance d5 between two neighboring adhesive portions in the unfolded state.

12. A system comprising a first LED strip according to claim 6 and a second strip for attaching to a part of the upper surface of the first LED strip, when the first LED strip is in folded state, for stabilizing the first LED strip.

13. The LED strip according to claim 11, wherein the distance d5 is larger or equal to the circumference of one loop in the folded state, and/or is smaller or equal to the distance between the middle of two neighboring LEDs in the unfolded state.

14. The system according to claim 12, wherein the second strip is a second LED strip, comprising a plurality of LEDs, for each loop of the plurality of first loops of the first LED strip, the first pre-bended portion and the second pre-bended portion abut a LED of the plurality of LEDs of the second LED strip.

* * * * *